US011547894B2

(12) United States Patent
Juen

(10) Patent No.: US 11,547,894 B2
(45) **Date of Patent: *Jan. 10, 2023**

(54) VERTICAL WEIGHT RACK

(71) Applicant: Andrew Kenneth Juen, Henderson, NV (US)

(72) Inventor: Andrew Kenneth Juen, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/304,016

(22) Filed: Jun. 12, 2021

(65) Prior Publication Data

US 2022/0032112 A1 Feb. 3, 2022

Related U.S. Application Data

(63) Continuation of application No. 14/308,381, filed on Jun. 18, 2014, now Pat. No. 11,033,771.

(60) Provisional application No. 61/836,554, filed on Jun. 18, 2013.

(51) Int. Cl.
*A63B 21/16* (2006.01)
*A63B 21/072* (2006.01)

(52) U.S. Cl.
CPC ..... *A63B 21/169* (2015.10); *A63B 21/0726* (2013.01)

(58) Field of Classification Search
CPC ..... A63B 21/169; A63B 21/0726; A63B 71/0036; A63B 21/072; A47B 81/005; A47B 88/20; A47F 7/0035; A47F 5/08; A47F 5/0884; A47F 7/0028; A47F 7/0021; A47F 7/005; A47F 7/0007
USPC ..... 211/86.01, 119.001, 119.004, 88.04, 6, 211/16, 49.1, 85.5, 193, 18, 70.6, 87.01, 211/75, 69, 70.8, 60.1, 64, 85.7; 248/224.8, 339, 690, 304, 301; 206/372–378, 477, 481, 483, 489
See application file for complete search history.

(56) References Cited

U.S. PATENT DOCUMENTS

D150,797 S * 8/1948 Lane ..... D6/682.2
D180,106 S * 4/1957 Seifert ..... D6/682.4
2,797,851 A * 7/1957 Leake ..... A01K 97/08 224/482
2,946,452 A * 7/1960 Caloiero ..... A47B 81/005 211/4
3,081,056 A * 3/1963 Sweet ..... B25H 3/04 248/552
3,288,304 A * 11/1966 Graves ..... A47B 81/005 211/64
D218,616 S * 9/1970 Owen ..... D7/701
3,731,817 A * 5/1973 Fowlkes ..... A01K 97/08 211/70.8
4,310,094 A * 1/1982 Hotchkiss, Jr. ..... B25H 3/04 211/70.6
4,648,516 A * 3/1987 Elkins ..... A47B 81/005 211/64

(Continued)

*Primary Examiner* — Jennifer E. Novosad
(74) *Attorney, Agent, or Firm* — Gary L. Eastman, Esq.; Eastman IP

(57) ABSTRACT

A weight rack having an elongated base is provided. The base may include a front side and a rear side. The base may include a height that is substantially greater than a width. Protruding from the front side of the base includes a plurality of U-shaped cradles. The U-shaped cradles may be oriented along the height of the elongated base. Each of the U-shaped cradles may be formed to receive and secure a dumbbell.

4 Claims, 5 Drawing Sheets

(56) References Cited

U.S. PATENT DOCUMENTS 4,705,168 A * 11/1987 Ward ..... A47B 88/90 206/373
4,776,471 A * 10/1988 Elkins ..... A47B 57/52 211/64
D319,361 S * 8/1991 Moser ..... D7/701
D337,466 S * 7/1993 Moser ..... D6/570
D339,946 S * 10/1993 Moser ..... D6/570
5,431,074 A * 7/1995 Durante ..... B60B 29/007 81/124.4
D362,776 S * 10/1995 Thorn ..... D6/552
5,505,316 A * 4/1996 Lee ..... B25H 3/04 206/376
5,638,964 A * 6/1997 Ernst ..... B25H 3/04 206/376
D392,489 S * 3/1998 Ernst ..... D25/131
5,924,964 A * 7/1999 Hayden ..... A63B 21/4029 482/104
D424,141 S * 5/2000 Eckmann ..... D21/686
6,293,412 B1 * 9/2001 Draper ..... E05B 73/00 211/4
6,315,121 B1 * 11/2001 Hansen ..... B25H 3/04 206/376
D455,310 S * 4/2002 Webber ..... D21/686
6,390,309 B1 * 5/2002 Tucker ..... B63B 32/83 211/85.7
D469,293 S * 1/2003 Harms ..... D21/686
D469,294 S * 1/2003 Harms ..... D21/686
6,932,224 B1 * 8/2005 Sandberg ..... A47B 81/005 211/70.8
D528,612 S * 9/2006 Black ..... D21/552
7,178,670 B2 * 2/2007 Chen ..... B25H 3/04 206/376
D543,078 S * 5/2007 Davalos ..... D7/701
D555,961 S * 11/2007 Lien ..... D6/552
7,678,030 B2 * 3/2010 Savage ..... A63B 71/0036 482/104
8,210,366 B2 * 7/2012 Kahn ..... B63B 32/80 211/85.7
8,403,155 B1 * 3/2013 Kao ..... B25H 3/04 211/70.6
8,596,590 B2 * 12/2013 McCoy ..... F16L 3/223 248/68.1
8,973,766 B2 * 3/2015 Sprang, Jr. ..... B25H 3/04 211/70.6
9,156,393 B2 * 10/2015 Sprang, Jr. ..... B25H 3/04
11,033,771 B2 * 6/2021 Juen ..... A63B 21/0726
2005/0009671 A1 * 1/2005 Hummer, Jr. ..... A63B 71/0036 482/94
2005/0051445 A1 * 3/2005 Meehan ..... A63B 71/0036 206/372
2009/0211996 A1 * 8/2009 Webber ..... A47F 7/0028 211/85.7
2009/0218302 A1 * 9/2009 Winnard ..... B25H 3/003 211/70.6
2014/0367351 A1 * 12/2014 Juen ..... A63B 21/169 211/85.7

* cited by examiner

VERTICAL WEIGHT RACK

CROSS-REFERENCE TO RELATED APPLICATION

This application claims the benefit of priority of U.S. Utility patent application Ser. No. 14/308,381, titled "Vertical Weight Rack", filed Jun. 18, 2014 and currently co-pending, which claims priority to provisional application No. 61/836,554, filed Jun. 18, 2013, the contents of which are herein incorporated by reference.

BACKGROUND OF THE INVENTION

The present invention relates to a weight rack and, more particularly, to a vertical weight rack that attaches to a surface.

Generally, a standard gymnasium, fitness studios and country clubs with gyms provides dumbbells for their patrons to use for weight lifting. Dumbbells require racks to keep the different weights organized and to prevent injury due to tripping over dumbbells on the floor. Currently, floor racks are utilized to store dumbbells. However, floor racks take up a lot of space. For example, the floor racks may take up between 10 to 30 square feet of usable floor space. Fitness studios, country clubs and gyms need as much usable space for their patrons as possible. By removing standard dumbbell racks, the facility may gain valuable floor space that it otherwise would not have.

As can be seen, there is a need for a weight rack that saves space.

SUMMARY OF THE INVENTION

In one aspect of the present invention, a weight rack comprises: an elongated base comprising a front side and a rear side, wherein the elongated base comprises a height substantially greater than a width; and a plurality of U-shaped cradles protruding from the front side of the elongated base, wherein the plurality of U-shaped cradles are oriented along the height of the elongated base, wherein each of the plurality of U-shaped cradles is formed to receive and secure a dumbbell.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention may include a wall mounted storage system for dumbbells. The present invention may include a Li-channel that may be made of a metal such as steel or aluminum. The U-shaped channel may cradle the dumbbells handle or head. The present invention provides the storage of dumbbells utilizing a wall instead of a traditional dumbbell rack which takes up valuable space. The present invention takes up little floor space by mounting the racks on the wall, which allows for more efficiency and comfort for the patrons.

Figure 1:
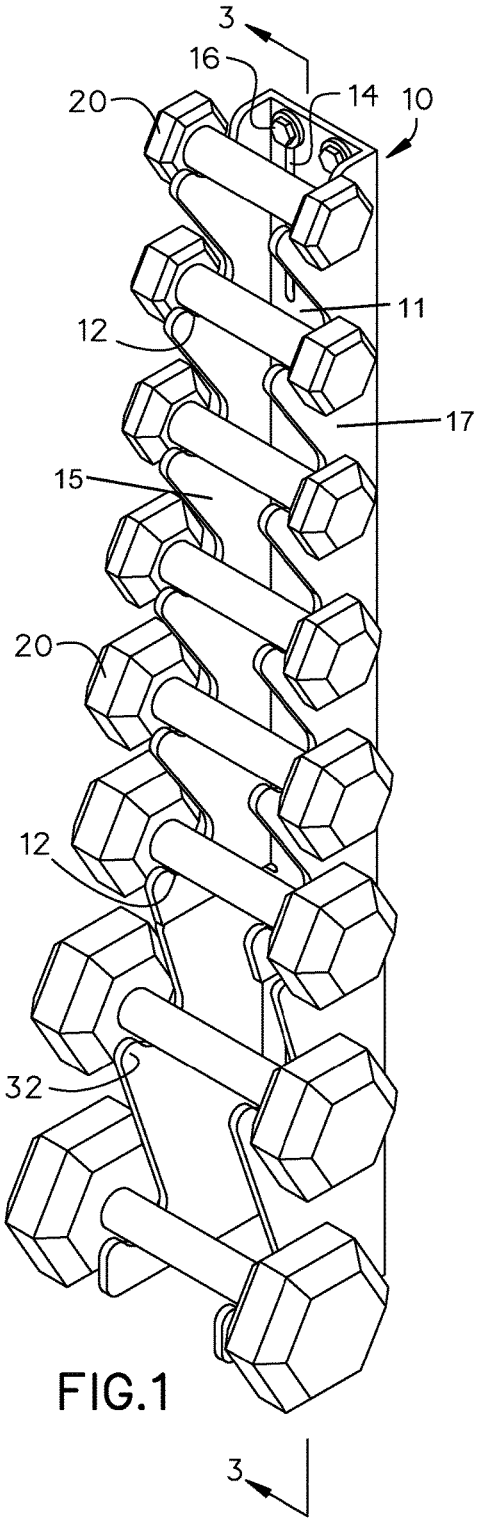
FIG. 1 is a perspective view of the present invention shown in use.
Figure 2:
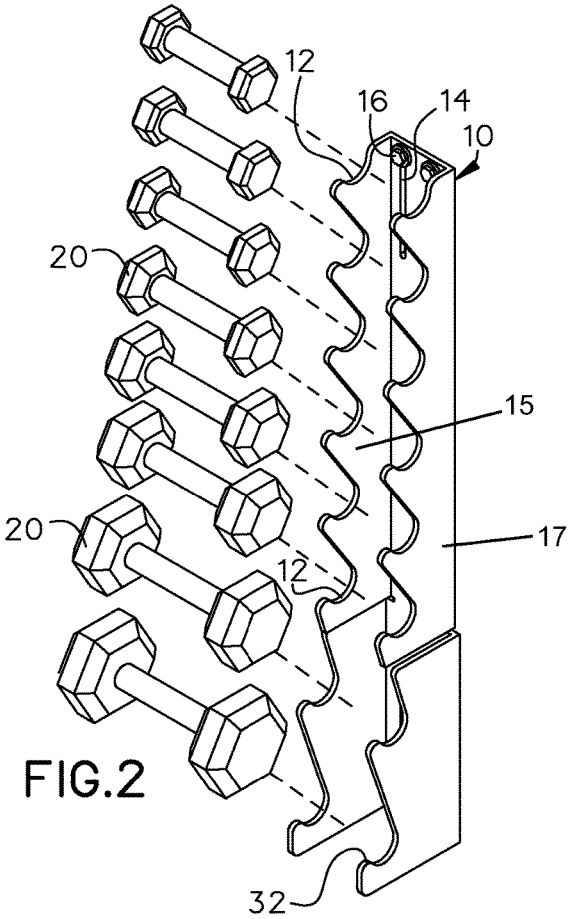
FIG. 2 is an exploded view of the in-use present invention.
Figure 3:
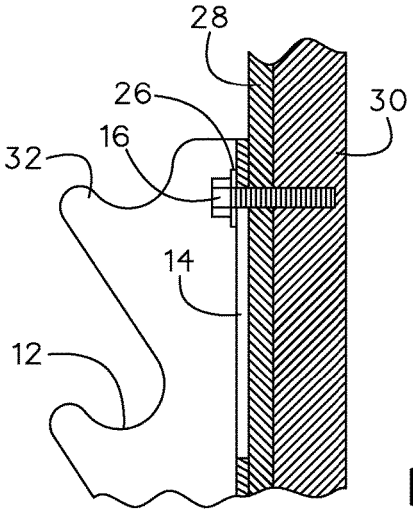
FIG. 3 is a detail section view of the present invention along line 3-3 in FIG. 1.
Figure 4:
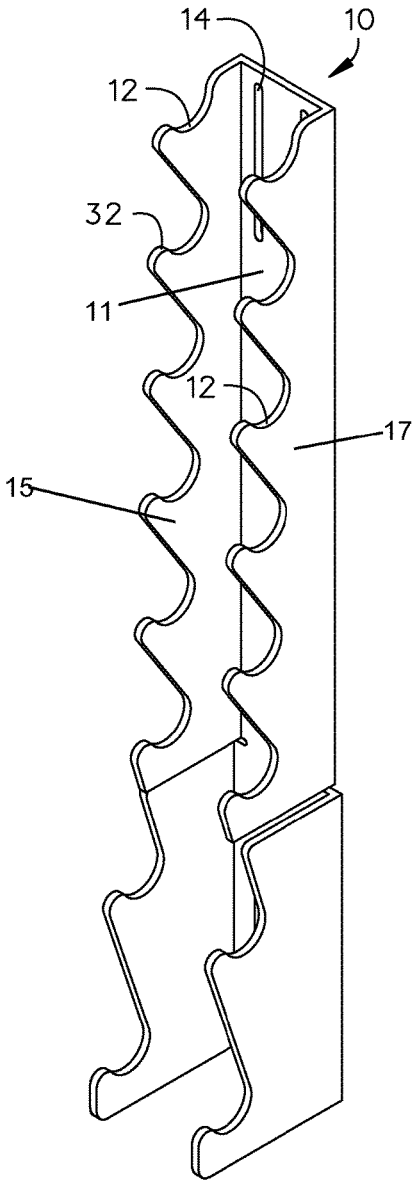
FIG. 4 is a perspective view of the present invention.
Figure 5:
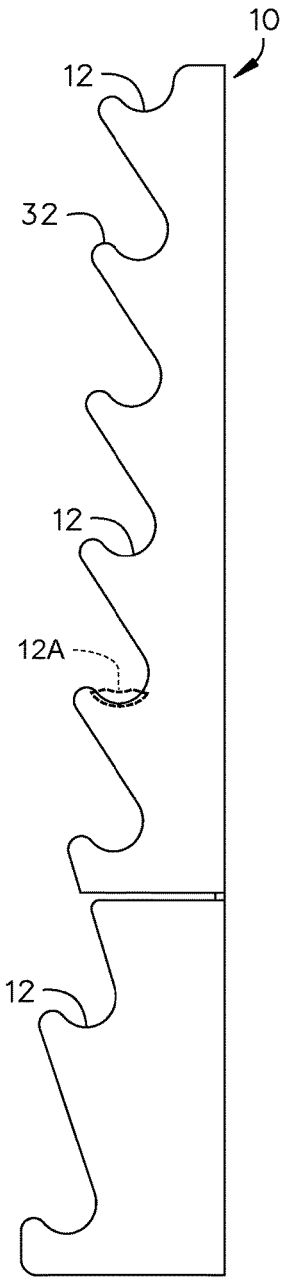
FIG. 5 is a side view of the present invention.
Figure 6:
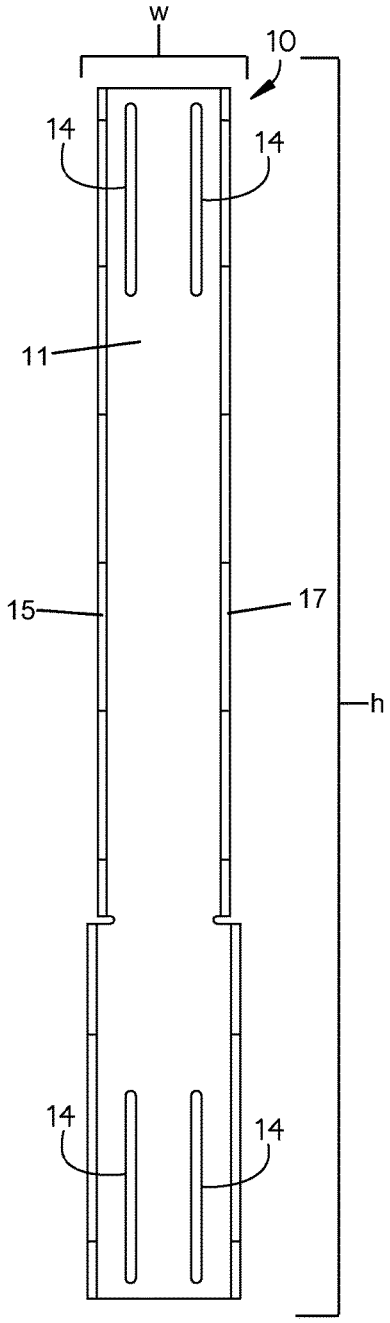
FIG. 6 is a front view of the present invention.
Figure 7:
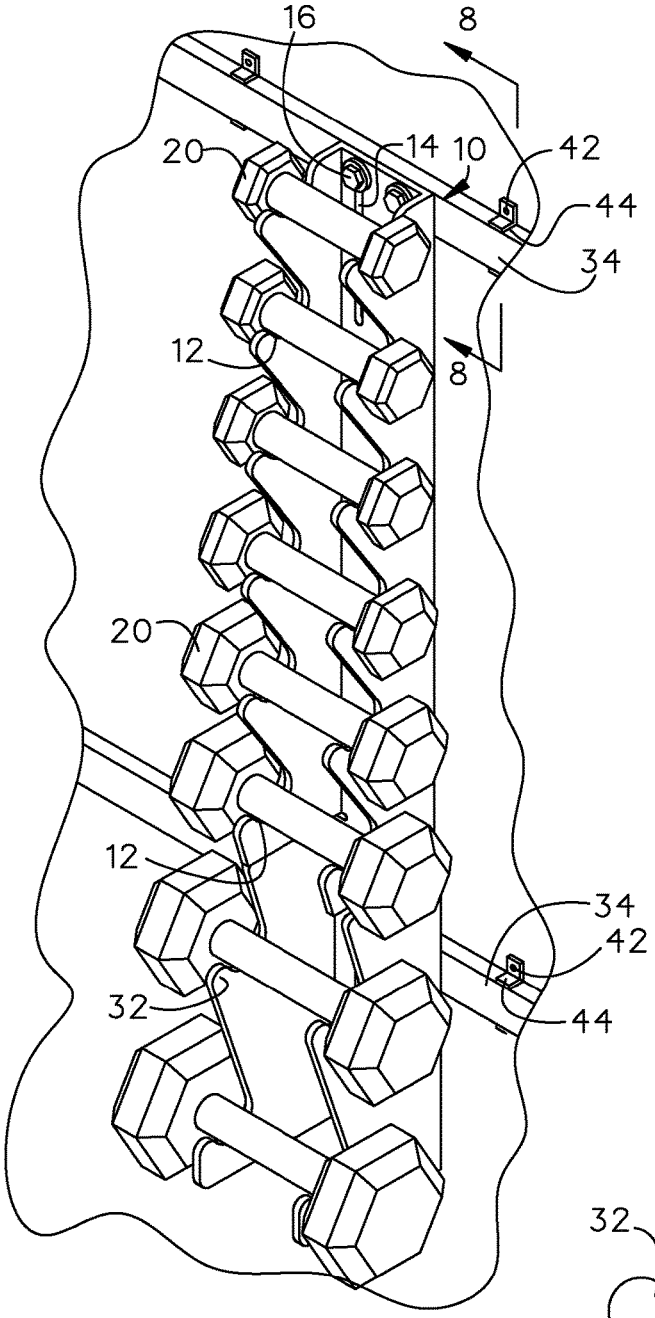
FIG. 7 is a perspective view of an alternate embodiment of the present invention.
Figure 8:
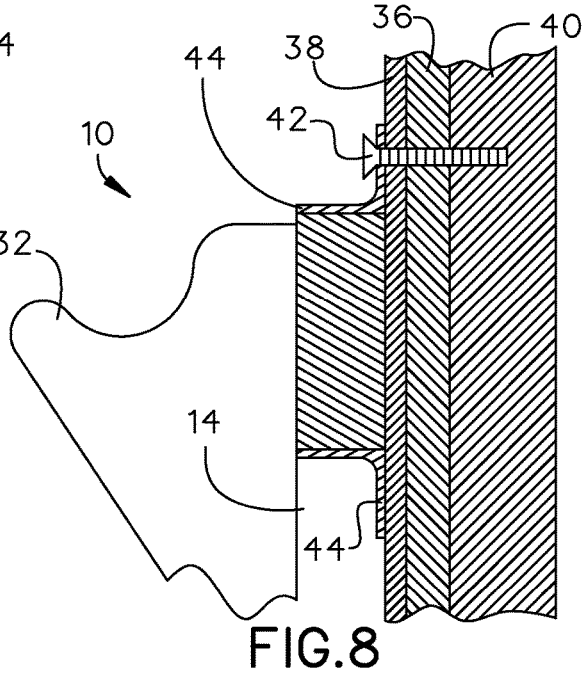
FIG. 8 is a section detail view of an alternate embodiment of the present invention along line 8-8 in FIG. 7.
Figure 9:
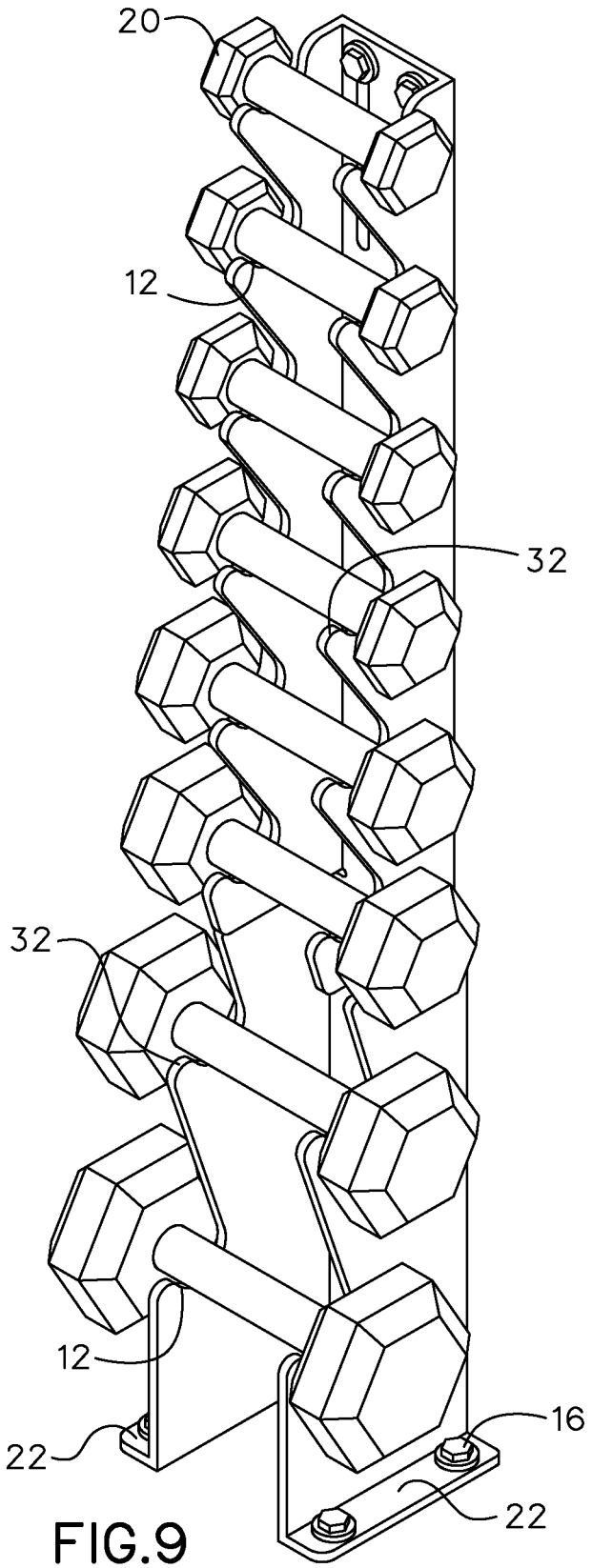
FIG. 9 is a perspective view of an alternate embodiment of the present invention shown in use.
Figure 10:
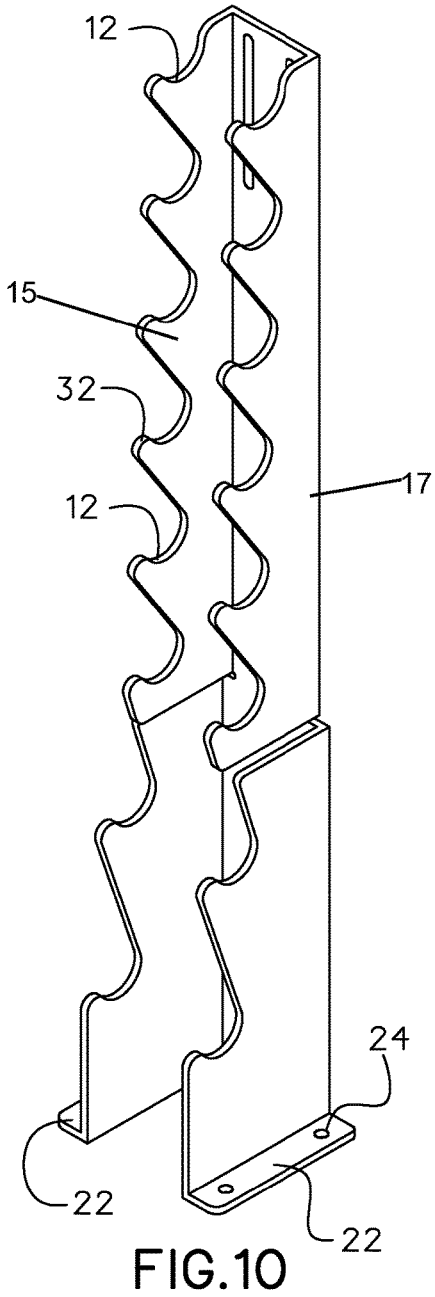
FIG. 10 is a perspective view of an alternate embodiment of the present invention.
Figure 11:
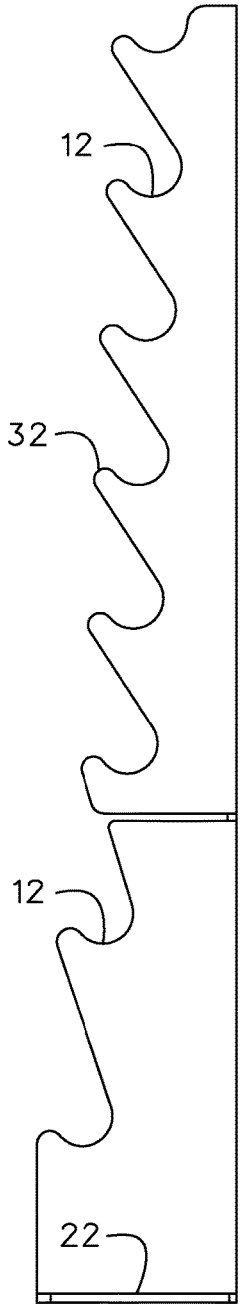
FIG. 11 is a side view of an alternate embodiment of the present invention.
Figure 12:
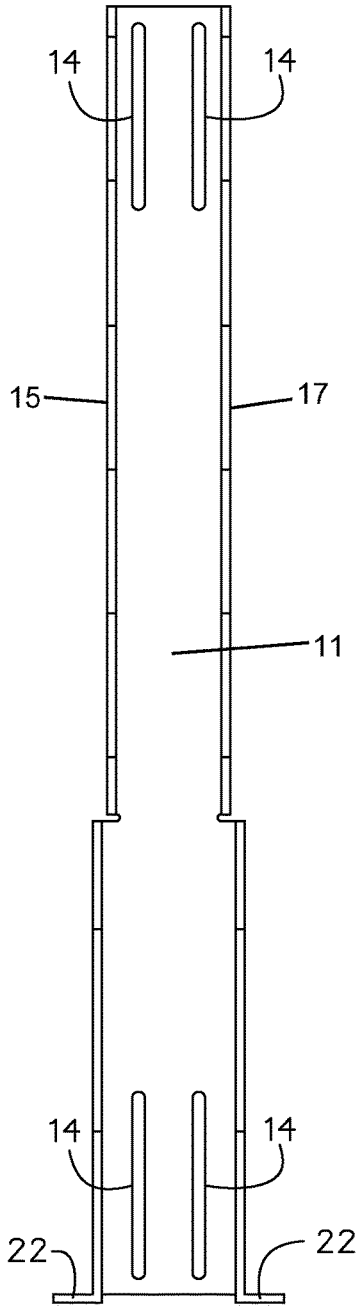
FIG. 12 is a front view of an alternate embodiment of the present invention.

Referring to FIGS. 1 through 12, the present invention includes a weight rack 10 having an elongated base 11. The base 11 may include a front side and a rear side. The base 11 may include a height (h) that is substantially greater than width (w). Protruding from the front side of the base 11 includes a plurality of U-shaped cradles 32. The U-shaped cradles 32 may be oriented along the height of the elongated base 11. Each of the U-shaped cradles 32 may be formed to receive and secure a dumbbell 20. In certain embodiments, the rear side of the elongated base 11 may be substantially flat and may be mounted directly to a wall 28 by a connector. In such embodiments, the elongated base 11 may include a plurality of slots 14 running through the front side and the rear side. The connector may include a plurality of bolts 16 that run through the slots 14 and into the wall 28 and stud 30. Washers 26 may be used to help secure the elongated base 11 to the wall 28.

The weight rack 10 of the present invention may further be mounted to a support mount 34 by the bolts 16. The support mount 34 may include an aluminum extruded support mount 34. The support mount 34 may be mounted to plywood 38, which is attached to a rubber material 36, which may be attached to a metal stud 40. The support mount 34 may be attached to the plywood 38 by a bracket 44 and screw fasteners 42.

The present invention may further include a first side 15 and a second side 17 protruding from the front side of the base 11. A plurality of aligning channels 12 are formed on the first side and the second side forming the plurality of U-shaped cradles 32. The plurality of U-shaped cradles 32 may align vertically with one another along the height of the elongated base 11.

In certain embodiments, the first side 15 and the second side 17 include a top portion and a bottom portion. As illustrated in the FIGS. 4 through 6, the first side 15 and the second side 17 may have a greater length at the bottom portion than at the top portion. Further, a distance between the first side 15 and the second side 17 may be greater at the bottom portion than the top portion. The increased dimensions of the bottom portion may accommodate for larger sized and weighted dumbbells 20.

The weight rack 10 of the present invention may be bolted to the ground surface. In such embodiments, a first flange 22 may extend from the first side 15 of the bottom portion, and a second flange 22 may extend from the second side 17 of the bottom portion. The first and second flange 22 may each include a slot 24. A bolt 16 may be inserted into the slot and bolted to the ground, thereby securing the weight rack 10 to the surface.

There may be multiple configurations of the present invention. For example, there may be a weight rack 10 that holds three pairs of dumbbells 20 that have head diameters of six inches or less. There may also be a weight rack 10 that holds four pairs of dumbbells 20 with head diameters of under four inches. The space between the handle cradles 20 may determine the amount and type of dumbbell that may be stored.

In certain embodiments, the racks 10 may be manufactured out of sheet aluminum or steel. The flat design may be laser cut, or water-jet cut, then bent into shape to form the U shape. Plastic, rubber or foam guards may be placed within the channels 12 to protect the U-shaped cradles 32.

It should be understood, of course, that the foregoing relates to exemplary embodiments of the invention and that modifications may be made without departing from the spirit and scope of the invention as set forth in the following claims.

What is claimed is:

1. A weight rack comprising:

an elongated base comprising a front side, a rear side, an upper end, and a lower end, wherein the elongated base comprises a height substantially greater than a width; and a plurality of U-shaped cradles protruding from the front side of the elongated base, wherein the plurality of U-shaped cradles are oriented along the height of the elongated base and extend away from the base, wherein a top U-shaped cradle of the plurality of U-shaped cradles extends away from the base at a predetermined length, and each subsequent U-shaped cradle of the plurality of U-shaped cradles extends away from the base at a length larger than the length of the U-shaped cradle above it, wherein each of the plurality of U-shaped cradles is configured such that a dumbbell may be securely placed into it, and wherein the rear side of the elongated base is substantially flat and configured for mounting to a wall by a connector; and a first side and a second side protruding from the front side of the elongated base, wherein a plurality of aligning channels are formed on the first side and the second side forming the plurality of U-shaped cradles, wherein each of the first side and the second side comprises a top portion and a bottom portion, wherein a first distance is between the first side and the second side at the top portion, wherein a second distance is between the first side and second side at the bottom portion, and wherein the second distance is greater than the first distance.

2. The weight rack as recited in claim 1, further comprising a dumbbell positioned in each U-shaped cradle.

3. A weight rack comprising:

an elongated base comprising a front side, a rear side, an upper end, and a lower end, wherein the elongated base comprises a height substantially greater than a width; and a plurality of U-shaped cradles protruding from the front side of the elongated base, wherein the plurality of U-shaped cradles are oriented along the height of the elongated base and extend away from the base, wherein a top U-shaped cradle of the plurality of U-shaped cradles extends away from the base at a predetermined length, and a bottom U-shaped cradle of the plurality of U-shaped cradles extends away from the base at a length larger than the length of top U-shaped cradle, wherein each of the plurality of U-shaped cradles is configured such that a dumbbell may be securely placed into it, and wherein the rear side of the elongated base is substantially flat and configured for mounting to a wall by a connector; and a first side and a second side protruding from the front side of the elongated base, wherein a plurality of aligning channels are formed on the first side and the second side forming the plurality of U-shaped cradles, wherein each of the first side and the second side comprises a top portion and a bottom portion, wherein a first distance is between the first side and the second side at the top portion, wherein a second distance is between the first side and second side at the bottom portion, and wherein the second distance is greater than the first distance.

4. The weight rack as recited in claim 3, further comprising a dumbbell positioned in each U-shaped cradle.

* * * * *